US008534087B2

(12) United States Patent
Lee et al.

(10) Patent No.: US 8,534,087 B2
(45) Date of Patent: Sep. 17, 2013

(54) REFRIGERATOR

(75) Inventors: Dong-Hoon Lee, Seoul (KR); Dong-Hoon Lee, Seoul (KR); Tae-Hee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 672 days.

(21) Appl. No.: 12/620,721

(22) Filed: Nov. 18, 2009

(65) Prior Publication Data

US 2010/0122543 A1 May 20, 2010

(30) Foreign Application Priority Data

Nov. 19, 2008 (KR) ..... 10-2008-0115387

(51) Int. Cl.
*A23G 9/00* (2006.01)

(52) U.S. Cl.
USPC ..... 62/345; 62/73

(58) Field of Classification Search
USPC ..... 62/73, 340, 344, 345, 347, 351, 353, 62/449; 312/401, 405, 405.1
See application file for complete search history.

(56) References Cited

U.S. PATENT DOCUMENTS

| | | | | |
|---|---|---|---|---|
| 7,437,885 | B2 | 10/2008 | Wu et al. | |
| 7,849,707 | B2 * | 12/2010 | Wu | 62/344 |
| 7,900,470 | B2 * | 3/2011 | Rafalovich et al. | 62/351 |
| 7,946,125 | B2 * | 5/2011 | Visin et al. | 62/344 |
| 8,042,353 | B2 * | 10/2011 | Lee et al. | 62/344 |
| 8,096,142 | B2 * | 1/2012 | Visin et al. | 62/344 |
| 8,109,114 | B2 * | 2/2012 | Lee et al. | 62/353 |
| 2006/0086135 | A1 | 4/2006 | Wu et al. | |
| 2010/0043459 | A1 | 2/2010 | Wu et al. | |
| 2010/0229590 | A1 * | 9/2010 | Riccardi et al. | 62/345 |

FOREIGN PATENT DOCUMENTS

| | | | |
|---|---|---|---|
| CN | 1769822 | A | 5/2006 |
| EP | 1 653 178 | A2 | 5/2006 |
| EP | 1 865 276 | A1 | 12/2007 |
| JP | 2003-279205 | A | 10/2003 |
| KR | 2007033514 | A | 3/2007 |
| KR | 2008018641 | A | 2/2008 |
| KR | 2008019904 | A | 3/2008 |
| KR | 2008041059 | A | 5/2008 |
| WO | WO 2007141170 | A2 * | 12/2007 |
| WO | WO 2008/026843 | A1 | 3/2008 |

OTHER PUBLICATIONS

Chinese Office Action dated Oct. 31, 2012 for Application No. 200980144094.7 with English Translation, 21 pages.
International Search Report & Written Opinion issued in Application No. PCT/KR2009/006811, mailed Jun. 23, 2010, 11 pages.

* cited by examiner

*Primary Examiner* — Melvin Jones
(74) *Attorney, Agent, or Firm* — Fish & Richardson P.C.

(57) ABSTRACT

A refrigerator includes an ice maker positioned in the refrigerator and configured to make ice. The refrigerator also includes a plate positioned at an open side of the ice making tray and configured to reduce water overflow. The refrigerator further includes a cool air inlet passage configured to allow cool air to be introduced to an area inside of the plate. In addition, the refrigerator includes a cool air outlet passage that is separate from the cool air inlet passage, and configured to allow release of cool air from the area inside of the plate to an exterior of the plate.

20 Claims, 7 Drawing Sheets

REFRIGERATOR

CROSS-REFERENCE TO RELATED APPLICATIONS

The present application claims the benefit of priority to Korean Application No. 10-2008-0115387, filed on Nov. 19, 2008, which is herein expressly incorporated by reference in its entirety.

FIELD

The present disclosure relates to a refrigerator having an ice maker

BACKGROUND

In general, a refrigerator is a device for keeping foods or the like in predefined accommodating spaces at a low temperature. The refrigerator may have a refrigerating chamber maintained at a temperature above zero and a freezing chamber maintained at a temperature below zero. Recently, as a demand of ice increases, a refrigerator having an automatic ice maker for making ice in the refrigerator is desired.

The automatic ice maker (hereinafter, referred to as 'ice maker') may be positioned either in a freezing chamber or in a refrigerating chamber according to a type of a refrigerator. In case of the ice maker being positioned in the refrigerating chamber, cool air within the freezing chamber is provided to the ice maker to make ice.

The ice makers may be classified into an ejector type and a rotation type based on a method of separating ice cubes made by the ice makers. The ejector type ice maker uses a method in which an ejector is disposed at an upper side of the ice maker to draw ice up from an ice making tray so as to separate the ice. The rotation type ice maker employs a method in which the ice maker is rotated to separate ice.

The ice maker may have a water overflow reducing plate for reducing the overflow of water at an upper side of the ice maker regardless of an ice separation method. The water overflow reducing plate reduces water running over the ice making tray to reduce the possibility of freezing adjacent components, e.g., a driving unit and the like. In case of the ice maker being positioned at a door of a refrigerator, impacts occur when the door is open and closed, and such impacts cause water to be slopped. Accordingly, such slopped water may run over the ice making tray and splash around the ice maker. Hence, when the ice maker is positioned at the door, the water overflow reducing plate may be positioned at an upper side of the ice making tray if possible.

However, in a case where the water overflow reducing plate is positioned at the upper side of the ice making tray, if cool air is supplied in a space defined by the water overflow reducing plate, the cool air may be accumulated. The accumulated cool air may then interfere with new cool air.

SUMMARY

In one aspect, a refrigerator includes an ice maker positioned in the refrigerator and configured to make ice. The refrigerator also includes an ice making tray associated with the ice maker and configured to retain water to be frozen. The refrigerator further includes a plate positioned at an open side of the ice making tray and configured to reduce water overflow from the ice making tray. In addition, the refrigerator includes a cool air inlet passage configured to allow cool air to be introduced to an area inside of the plate and a cool air outlet passage that is separate from the cool air inlet passage. The cool air outlet passage is configured to allow release, to an exterior of the plate, of the cool air introduced to the area inside of the plate.

Implementations may include one or more of the following features. For example, the cool air outlet passage may be positioned lower than the cool air inlet passage. The cool air outlet passage may be made by rotation of the ice making tray. The cool air outlet passage also may be made by rotation of the plate.

In some implementations, the cool air outlet passage may be made by a relative rotation between the ice making tray and the plate. The refrigerator may include a driving unit coupled to the ice making tray or the plate and configured to rotate the ice making tray or the plate.

In some examples, the refrigerator may include a control unit configured to provide a control signal to the driving unit to rotate the ice making tray or the plate. In these examples, the control unit may be configured to detect a status of water retained in the ice making tray and provide the control signal to the driving unit based on the detected status. Further, the control unit may include a sensor configured to detect a temperature of water in the ice making tray or a surface of the ice making tray and a microprocessor configured to receive the detected temperature, determine whether a portion of the water in the ice making tray is frozen based on the detected temperature, and provide the control signal to the driving unit based on the determination.

The ice maker may be positioned at a refrigerator door. The refrigerator may include at least one heater that is associated with the ice maker and configured to heat the ice making tray to promote separation of ice from the ice making tray.

In another aspect, a refrigerator includes an ice maker positioned in the refrigerator and configured to make ice and an ice making tray associated with the ice maker and configured to retain water to be frozen. The refrigerator also includes a plate positioned at an open side of the ice making tray and configured to reduce water overflow from the ice making tray. The refrigerator further includes a driving unit configured to move the ice making tray to make a cool air outlet passage between the ice making tray and the plate.

Implementations may include one or more of the following features. For example, the refrigerator may include a control unit configured to provide a control signal to the driving unit in response to detecting a status of water in the ice making tray. In this example, the control unit may include a sensor configured to detect a temperature of water in the ice making tray or a surface of the ice making tray and a microprocessor configured to receive the detected temperature, determine whether a portion of the water in the ice making tray is frozen based on the detected temperature, and provide the control signal to the driving unit based on the determination.

In some implementations, the refrigerator may include at least one heater that is associated with the ice maker and configured to heat the ice making tray to promote separation of ice from the ice making tray. In these implementations, the refrigerator may include a control unit configured to determine whether an ice making operation is completed based on a predetermined time elapsing or detecting a temperature of the ice making tray and configured to provide a control signal to the at least one heater to heat the ice making tray based on a determination that the ice making operation is completed.

In yet another aspect, an ice making method includes supplying, through a cool air inlet, cool air to an ice making tray retaining water and determining whether a portion of water retained in the ice making tray is frozen. The method also includes establishing a cool air outlet passage by moving the ice making tray based on determining that the portion of water is frozen and separating ice from the ice making tray when the water retained in the ice making tray is frozen.

Implementations may include one or more of the following features. For example, the method may include detecting a temperature of the ice making tray. The method also may include, before separating the ice from the ice making tray, heating the ice making tray by at least one heater. The method further may include stopping supply of cool air into the ice making tray prior to separating the ice.

DETAILED DESCRIPTION

Figure 1:
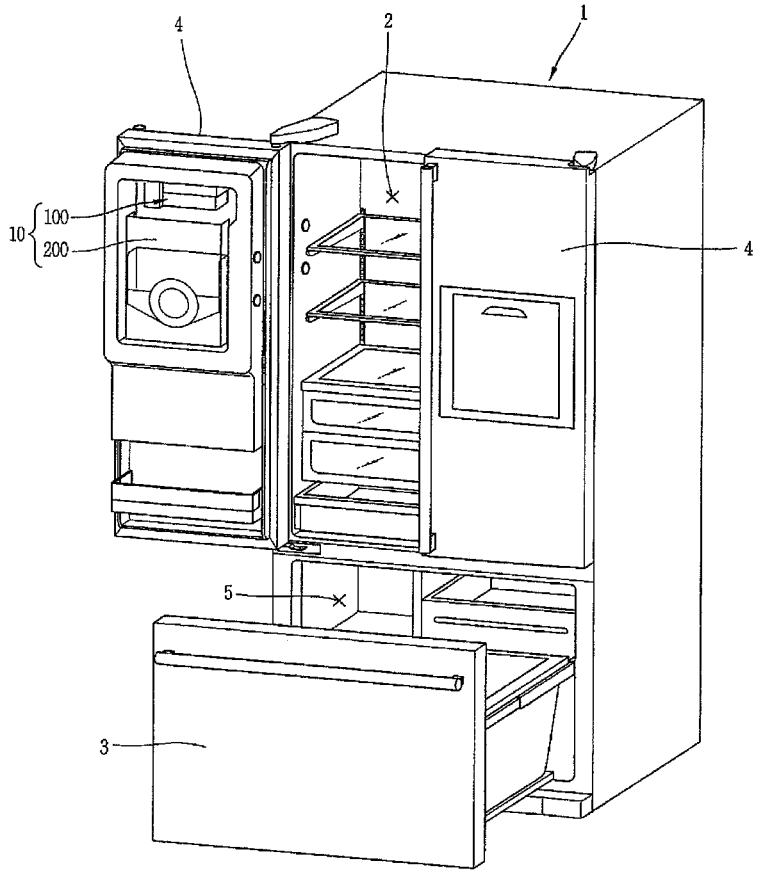
FIG. 1 is a perspective view showing a bottom freezer type refrigerator having an ice maker.

As shown in FIG. 1, a refrigerator may include a refrigerating chamber 2 positioned at an upper side of a refrigerator main body 1 for storing foods in a fresh state, and a freezing chamber 5 positioned at a lower side of the refrigerator main body 1 for storing foods in a frozen state. A plurality of refrigerating chamber doors 4 for opening and closing the refrigerating chamber 2 may be located at both sides of the refrigerating chamber 2, and the freezing chamber 5 has one freezing chamber door 3 for opening and closing the freezing chamber 5. A machine chamber having a compressor and a condenser may be positioned at a lower end portion of a rear surface of the refrigerator main body 1. An evaporator of the refrigerator is connected to the condenser and the compressor for supplying cool air into the refrigerating chamber 2. In some examples, the evaporator for the freezing chamber 5 may be positioned at a rear surface, side surface or upper surface of the refrigerator main body 1 or within a barrier dividing an inside of the refrigerator main body 1 into the refrigerating chamber 2 and the freezing chamber 5. The evaporator for the refrigerator may be implemented as a single evaporator. The single evaporator can supply cool air into the refrigerating chamber 2 and the freezing chamber 5. Alternatively, an evaporator for a refrigerating chamber and an evaporator for a freezing chamber may be individually provided to supply cool air into the refrigerating chamber 2 and the freezing chamber 5, respectively.

An ice making chamber 10 for making and storing ice cubes may be positioned at an inner wall surface of one of the refrigerating chamber doors 4, as shown in FIG. 1. An ice maker 100 for making ice cubes may be positioned in the ice making chamber 10. An ice bank 200 for storing ice cubes made by the ice maker 100 may be positioned below the ice maker 100. In other implementations, the ice, maker 100 may be positioned at the refrigerating chamber 2 and the ice bank 200 may be positioned at the refrigerator chamber door 4. The type of refrigerator may be a factor to decide a location of the ice making chamber 10, the ice maker 100, or the ice bank 200.

Figure 2:
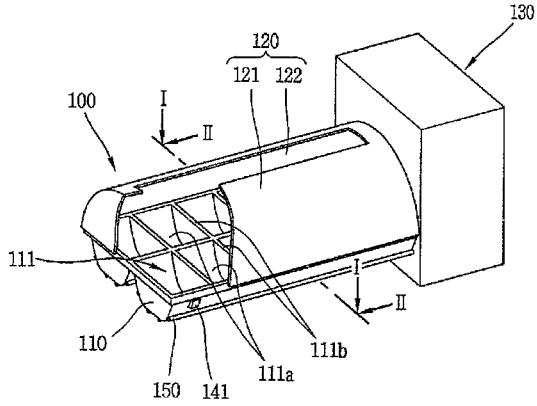
FIG. 2 is a perspective view showing the ice maker of FIG. 1.
Figure 3:
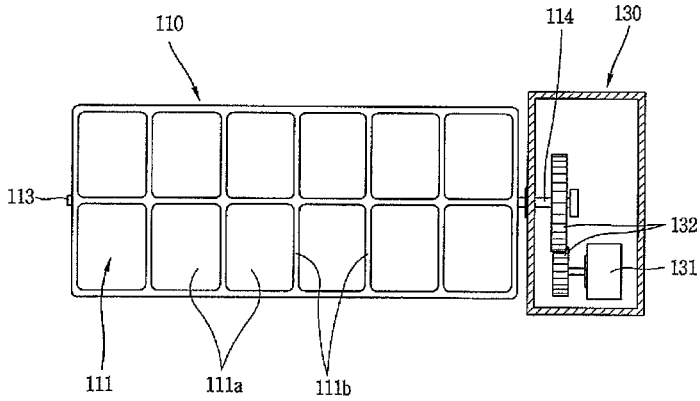
FIG. 3 is a cross-sectional view taken along the line "I-I" of FIG. 2.
Figure 4:
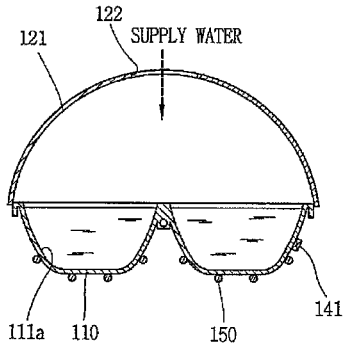
FIG. 4 is a cross-sectional view taken along the line "II-II" of FIG. 2.

Hereinafter, an ice maker in a refrigerator will be described with reference to FIGS. 2 to 4. As shown in FIGS. 2 to 4, the ice maker 100 may include an ice making tray 110 in which water is supplied from a water supply unit to be frozen into the ice cubes, and a water overflow reducing plate 120 which covers an upper side of the ice making tray 110 to reduce water from being run over the ice making tray 110.

The ice making tray 110 may have an ice making space 111 in which water is contained to be made into ice cubes. The ice making space 111 may be defined in a semi-cylindrical shape which is upwardly open. Ice cubes can be separated from the ice making tray 110 when the ice making tray 110 is turned over. The ice making space 111 may be defined in two parallel lines in a widthwise direction, as shown in FIG. 2. Alternatively, the ice making space 111 may be defined in a single line or in more than two parallel lines. Also, the ice making space 111 may be defined in a different shape other than the semi-cylindrical shape.

A plurality of ice making pockets 111*a* defining an actual shape of an ice cube may be positioned at an inner circumferential surface of the ice making space 111. The plurality of ice making pockets 111*a* may be divided by a plurality of pocket walls 111*b* in a lengthwise direction of the ice making space 111 with a uniform interval. An upper end surface of each pocket wall 111*b* may be configured to be curved such that water can move into each of the ice making pockets 111*a*.

The water overflow reducing plate 120 may include a body 121 for covering the upper side of the ice making tray 110, and a cool air inlet 122 positioned at a middle portion of the body 121, such as at an upper surface of the body 121 through which cool air supplied via a cool air duct is passed.

The body 121 may be defined in a semi-cylindrical shape having a lower side open, such as having an open surface facing an open surface of the ice making tray 110. However, without limit to the semi-cylindrical shape, the body 121 may be defined in any shape, for example, a space in which the body 121 is rotatable with respect to the ice making tray 110. Here, since the body 121 should perform a relative rotation with respect to the ice making tray 110, an inner circumferential surface of the body 121 may be defined in a circular shape.

The cool air inlet 122 may be configured as a single long hole in a lengthwise direction, as shown in FIG. 2. However, the cool air inlet 122 is not limited to the single long hole. For instance, the cool air inlet 122 may have a plurality of holes in the lengthwise direction or in a circumferential direction. So, any configuration may be available if the cool air inlet 122 has an area as great as cool air being smoothly provided into an inner space of the water overflow reducing plate 120. The cool air inlet 122 may be positioned near a top portion of the body 121.

The ice maker 100 may be configured such that if a surface of water contained in the ice making tray 110 is frozen to some degree, the ice making tray 110 is rotated to make cool air rapidly circulated in the ice maker 100, thus an ice making speed is increased. Further, a driving unit 130 for rotating the ice making tray 110 may be positioned at one side of the ice making tray 110.

Referring to FIG. 3, a first hinge shaft 113 and a second hinge shaft 114 are defined at both sides of the ice making tray 110 in a lengthwise direction. The first hinge shaft 113 is coupled to the ice making chamber 10 by a hinge while the second hinge shaft 114 is coupled to a rotary shaft of a rotation motor 131 or a middle gear 132 so as to receive a rotational force from the rotation motor 131. Here, as another implementation, the first hinge shaft 113 may be deleted from the above example. So, the ice making tray 110 may be supported by only the second hinge shaft 114.

The driving unit 130 may include the rotation motor 131 for generating a rotational force, and the middle gear 132 coupled to the rotary shaft of the rotation motor 131 for decreasing a rotative velocity of the rotation motor 131. The middle gear 132 may be coupled to the second hinge shaft 114 of the ice making tray 110.

The rotation motor 131 may be configured to rotate in forward and backward directions or in a single direction. However, in order to prevent an entanglement of wires due to the rotation of the ice making tray 110, the rotation motor 131 of the driving unit 130 may be rotatable in the forward and backward directions. The wires connect components positioned in the ice making tray 110. Further, the rotational force of the rotation motor 131 may be transferred to the ice making tray 110 by using a middle pulley and a belt instead of the middle gear 132.

The ice making tray 110 may be rotated after the surface of water contained in the ice making tray 110 is frozen to some degree. If the ice making tray 110 is rotated before the surface of water contained in the ice making tray 110 is frozen, the water may be poured on the adjacent components and freeze them. Therefore, the ice maker 100 may need a control unit, which is electrically coupled to the driving unit 130 to determine whether the surface of water contained in the ice making tray 110 is frozen. The control unit controls the operation of the driving unit 130 based on the result of the determination.

The control unit may include a temperature sensor 141 for sensing (detecting) a temperature of the ice making tray 110 as shown in FIG. 2, and a microcomputer for comparing the temperature of the ice making tray 110 detected by the temperature sensor 141 with a reference temperature to determine whether the surface of water contained in the ice making tray 110 is frozen.

The temperature sensor 141 may be implemented as a contact-type temperature sensor which is directly in contact with the surface of the ice making tray 110 to detect the surface temperature of the ice making tray 110. Alternatively, the temperature sensor 141 may be implemented as a non-contact-type temperature sensor which is positioned to be spaced apart from the surface of the ice making tray 110 to indirectly detect the temperature of the ice making tray 110. An infrared sensor may be used as the non-contact-type temperature sensor.

The temperature sensor 141 may periodically detect the temperature of the ice making tray 110 with a predetermined time or interval, and the microcomputer may determine whether the surface of water is frozen based on a result of the comparison. Alternatively, the temperature sensor 141 may detect the temperature of the ice making tray 110 in real time, and the microcomputer may determine whether the surface of water is frozen based on the detected temperature.

The control unit of the ice maker 100 may detect the surface temperature of the ice making tray 110. However, in some cases, the control unit may directly detect a surface temperature of the water contained in the ice making tray 110 to determine whether the water is frozen.

Figure 5:
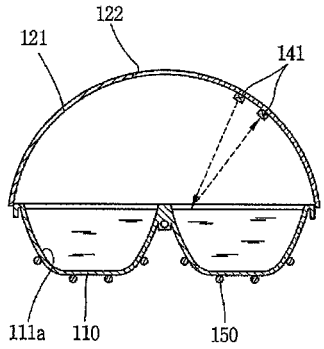
FIG. 5 is a longitudinal sectional view showing an implementation of the ice maker of FIG. 2.

As shown in FIG. 5, an infrared sensor 141 may be used as a sensor, which can detect the surface temperature of water contained in the ice making tray 110. The infrared sensor may include a light emitter and a light receiver at an inner circumferential surface of the water overflow reducing plate 120. The light emitter emits an infrared signal and the light receiver receives the returning signal reflected by a portion of the ice maker (e.g., water or ice in the ice making tray 110). The microcomputer thus determines whether the water is frozen based on the returning signal. As another example, the infrared sensor may be positioned at a surface facing the surface of water contained in the ice making tray 110, such as positioned at the refrigerator door or near a cool air duct instead of the water overflow reducing plate 120.

Further, the ice maker 120 may supply thermal energy to a boundary between the ice and the ice making tray 110 to help separation of the ice. For this implementation, as shown in FIG. 2, the ice maker 100 may further include a heater 150. The heater 150 may be configured to physically contact the ice making tray 110 or configured to be spaced apart from the ice making tray 110 by a preset gap. As an example, FIG. 2 shows that one or more heaters 150 are located over a bottom surface of the ice making tray 110. The heater may be configured to heat an entire bottom surface of the ice making tray 110.

In some examples, the heater 150 may be configured to cover one surface of the ice making tray 110, e.g., a bottom surface thereof. In this case, the heater 150 may be a conductive polymer, a plate heater with positive thermal coefficient, an aluminum thin film or other heat conductive material. The heater 150 may be positioned in the ice making tray 110 or at an inner surface of the ice making tray 110. Further, at least part of the ice making tray 110 is implemented as a resistor which can emit heat upon electricity being to applied.

As another example, the ice maker 100 may further include a heat generator (heat emitter), which is positioned to be spaced a part from the ice making tray 110. Examples of the heat generator may include a light source for emitting light to at least one of ice and the ice making tray 110, a magnetron for radiating microwaves to at least one of the ice and the ice making tray 110, or the like.

As mentioned above, the heat generator, such as the heater, the light source or the magnetron, may directly apply thermal energy to at least one of the ice and the ice making tray 110 or to a boundary therebetween, thereby to partially melt the boundary surface between the ice and the ice making tray 110. Accordingly, when the ice making tray 110 is rotated, the ice may be separated from the ice making tray 110 by its own weight.

In addition, a completion of ice making may be identified based on ice making time or a temperature of the ice making tray 110. For example, when a predetermined period or time elapses after water supply, the microcomputer determines that ice is completely made. Alternatively, when the temperature is below a reference temperature (e.g., −9° C.), the microcomputer determines that the ice making is completed.

Figure 6:
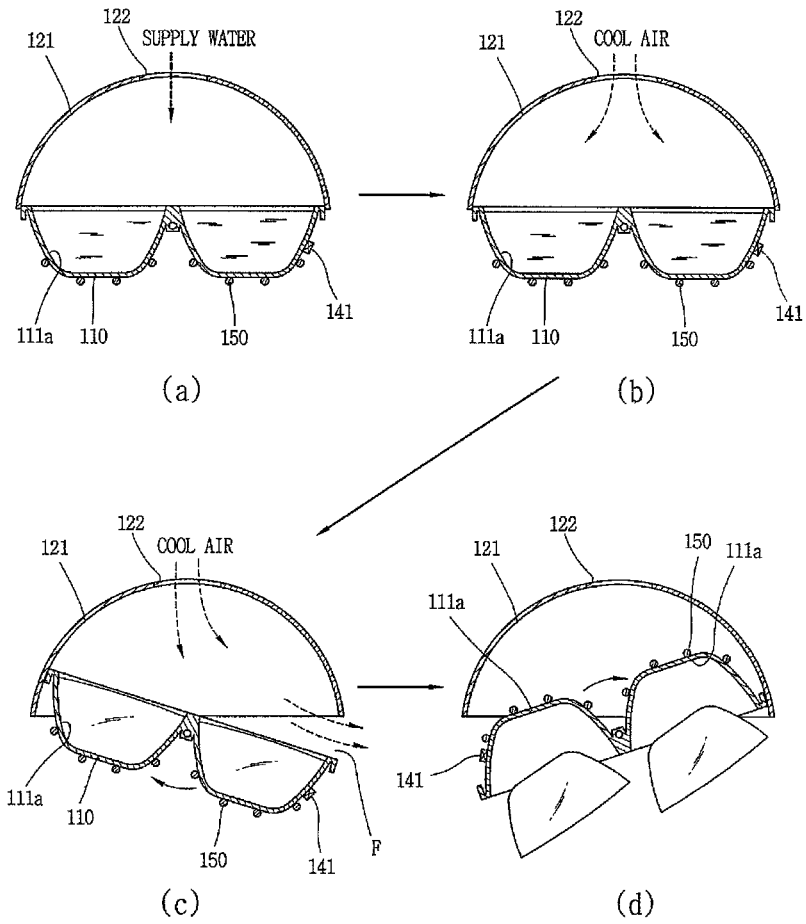
FIG. 6 is a longitudinal sectional view showing an ice making process of FIG. 2.
Figure 7:
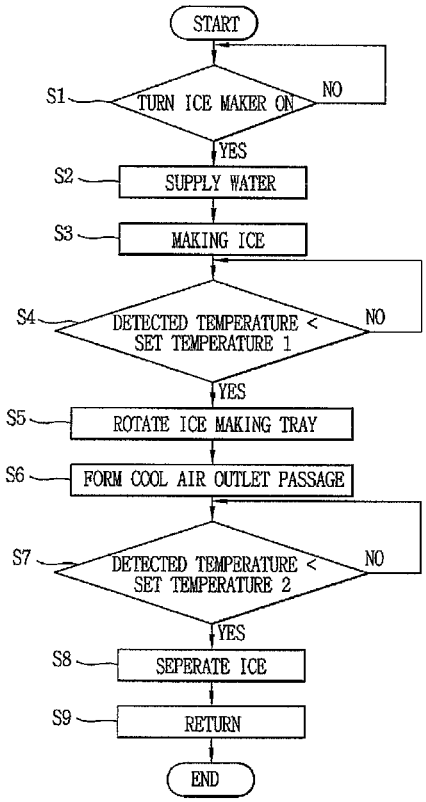
FIG. 7 is a flowchart showing an ice making method.

An ice making method using an ice maker in a refrigerator will be described hereinafter. As shown in FIGS. 6 and 7, upon ice making being requested, the ice maker 100 is turned on to start the ice making operation (S1). When the ice making operation is started, the water supply unit supplies water into the ice making pockets 111*a* of the ice making tray 110 (S2). After the water is completely supplied, the water contained in the ice making tray 110 is exposed to cool air supplied via the cool air duct for a predetermined time to be frozen (S3). The cool air supplied via the cool air duct is then provided into an inner space of the water overflow reducing plate 120 via the cool air inlet 122 of the water overflow reducing plate 120. The cool air cools the water contained in the ice making tray 110.

While the water in the ice making tray 110 is frozen, the temperature sensor 141 detects the temperature of the ice making tray 110 periodically or in real time and sends information related to the detected temperature to the microcomputer, and the microcomputer then compares the received detected temperature with a set temperature (S4). Based on the comparison, the microcomputer determines whether the surface of the water in the ice making tray 110 is frozen. If the surface of the water is determined to be frozen, the rotation motor 131 of the driving unit 130 is driven to rotate the ice making tray 110 (S5). Upon the ice making tray 110 being rotated by a predetermined angle, a cool air outlet passage F, as shown in FIG. 6(*c*), is generated between the ice making tray 110 and the water overflow reducing plate 120 (S6). The cool air provided via the cool air inlet 122 as a cool air inlet passage is then discharged via the cool air outlet passage F, such that cool air can quickly be circulated. Accordingly, the cool air in the inner space of the water overflow reducing plate 120 is not accumulated.

The temperature of the ice making tray 110 is detected again by the temperature sensor 141 and the detected temperature is compared with the set temperature (S7) in the microcomputer. Based on the comparison result, if the detected temperature is the same or lower than the set temperature, it is determined that the ice making operation is completed, and then a process for an ice separation is started (S8). For this operation, the driving unit 130 further rotates the ice making tray 110 in a forward or reverse direction. The ice making tray 110 may be rotated until the tray arrives at a position where the ice cube within the ice making tray 110 can be separated from the ice making tray 110 by its own weight.

Upon the completion of the ice separation, the ice making tray 110 is rotated in a backward direction to return to its initial position (S9). The series of processes are repeatedly performed to continue the ice making operation until the ice bank 200 is fully filled with the ice cubes.

Figure 8:
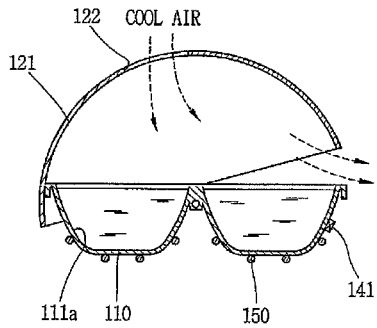
FIGS. 8 and 9 are a longitudinal sectional view and a plane view, respectively, showing other implementations of an ice maker.
Figure 9:
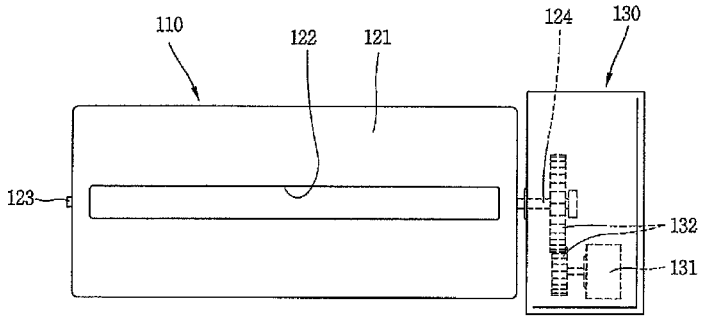

Now, another implementation of an ice maker in a refrigerator will be described with respect to FIGS. 8 and 9. As shown in FIG. 8, the water overflow reducing plate 120 other than the ice making tray 110 is rotated by a predetermined angle to make the cool air outlet passage F.

As such, even the rotation of the water overflow reducing plate 120 can make the cool air outlet passage F, the ice making speed may be as same as the rotation of the ice making tray 110. Further, the basic operation of rotation of the water overflow reducing plate 120 may be the same as that of the ice making tray 110. However, a difference is that the water overflow reducing plate 120 may be coupled to the driving unit 130. As shown in FIG. 9, a first hinge shaft 123 and a second hinge shaft 124 are coupled to both sides of the water overflow reducing plate 120. Also, the first hinge shaft 123 is coupled to the ice making chamber 10 by a hinge while the second hinge shaft 124 is coupled directly to a rotary shaft of the rotation motor 131 of the driving unit 130 or coupled to a deceleration member 132 such as a middle gear or a middle pulley. Alternatively, a single hinge shaft may be used at one side, other than both sides. In this case, the hinge shaft may be coupled to the driving unit 130.

Further, in a case that the water overflow reducing plate 120 is coupled to the driving unit 130, another driving unit for rotating the ice making tray 110 to separate ice from the ice making tray 110 may further be required. Alternatively, a single driving unit may be mechanically configured to selectively rotate the water overflow reducing plate 120 and the ice making tray 110. For example, the driving unit may provide a drive force to the water overflow reducing plate 120 to make a cool air outlet passage and then the driving unit is switched to the ice making tray 110 to provide the driving force to rotate the ice making tray 110 for separating ice cubes. As another example, the ice making tray 110 may be fixed and ice may be separated from the ice making tray 110 by use of an independent ejector.

When the water overflow reducing plate 120 is rotated, the cool air inlet 122 positioned at the water overflow reducing plate 120 may be rotated. The position of the cool air inlet passage is changed. So, it is necessary by considering a change, for example, to set a position of a cool air duct or the shape of the cool air inlet 122. However, in case that the water overflow reducing plate 120 is rotated, it is possible to reduce pouring out water in the ice making tray 110. Even the water overflow reducing plate 120 is rotated under a situation where the surface of water within the ice making tray 110 is not sufficiently frozen due to a sensing error of the temperature sensor 141, the water in the ice making tray 110 may be maintained.

Another implementation of an ice maker in a refrigerator will be described hereinafter. In this implementation, the cool air outlet passage is made without rotating the ice making tray.

Figure 10:
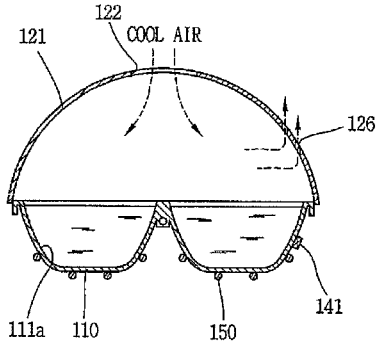
FIGS. 10 and 11 are a longitudinal sectional view and an enlarged sectional view, respectively, showing the other implementations of an ice maker.
Figure 11:
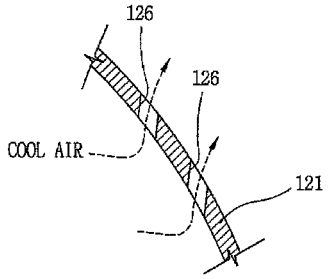

As shown in FIGS. 10 and 11, cool air outlets 126 may be made at the water overflow reducing plate 120. For example, the cool air outlets 126 may be positioned below the cool air inlet 122 to avoid it from overlapping with the cool air inlet 122. Further, the cool air outlets 126 may be perpendicular or be inclined upwardly from an inner circumferential surface of the water overflow reducing plate 120 toward an outer circumferential surface thereof to prevent the water from flowing out of the water overflow reducing plate 120. Because if the water runs over the ice making tray 110, the water may be splashed onto the inner circumferential surface of the water overflow reducing plate 120.

As described above, if a cool air inlet passage and a cool air outlet passage are independently positioned at the water overflow reducing plate 120, cool air introduced via the cool air inlet 122 can continuously flow via the cool air outlets 126. Accordingly, it is not needed to detect whether the surface of water within the ice making tray 110 is frozen. So the temperature sensor or the microcomputer for the detection and the determination may not be required. If the microcomputer has other function such as controlling an operation of the refrigerator, the microcomputer of the refrigerator may be needed. When a surface of water contained in the ice making tray is frozen, the ice making tray or the water overflow reducing plate is allowed to perform a relative rotation. Alternatively, the cool air outlets are positioned at the water overflow reducing plate to reduce cool air provided into an inner space of the water overflow reducing plate from being accumulated therein.

Further, the present disclosure may be applicable to any types of refrigerators, such as a side by side freezer or the like.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator, comprising:

an ice maker positioned in the refrigerator and configured to make ice;

an ice making tray associated with the ice maker and configured to retain water to be frozen;

a plate positioned at an open side of the ice making tray and configured to reduce water overflow from the ice making tray;

a cool air inlet passage configured to allow cool air to be introduced to an area inside of the plate; and a cool air outlet passage that is separate from the cool air inlet passage, and configured to allow release, to an exterior of the plate, of the cool air introduced to the area inside of the plate, wherein the cool air outlet passage is made by rotation of the ice making tray by an angle smaller than an ice separating angle at which the ice making tray is rotated to separate ice from the ice making tray.

2. The refrigerator of claim 1, wherein the cool air outlet passage is positioned lower than the cool air inlet passage.

3. The refrigerator of claim 1, further comprising:

a driving unit coupled to the ice making tray and configured to rotate the ice making tray.

4. The refrigerator of claim 1, further comprising:

a control unit configured to provide a control signal to the driving unit to rotate the ice making tray.

5. The refrigerator of claim 4, wherein the control unit is configured to detect a status of water retained in the ice making tray and provide the control signal to the driving unit based on the detected status.

6. The refrigerator of claim 4, wherein the control unit comprises:

a sensor configured to detect a temperature of water in the ice making tray or a surface of the ice making tray; and a microprocessor configured to receive the detected temperature, determine whether a surface portion of the water in the ice making tray is frozen based on the detected temperature, and, based on the determination, provide, to the driving unit, the control signal that rotates the ice making tray by the angle smaller than the ice separating angle so as to make the cool air outlet or rotates the ice making tray by the ice separating angle so as to separate ice from the ice making tray.

7. The refrigerator of claim 1, wherein the ice maker is positioned at a refrigerator door.

8. The refrigerator of claim 1, further comprising at least one heater that is associated with the ice maker and configured to heat the ice making tray to promote separation of ice from the ice making tray.

9. A refrigerator, comprising:

an ice maker positioned in the refrigerator and configured to make ice;

an ice making tray associated with the ice maker and configured to retain water to be frozen;

a plate positioned at an open side of the ice making tray and configured to reduce water overflow from the ice making tray;

a driving unit configured to rotate the ice making tray to make a cool air outlet passage between the ice making tray and the plate, the cool air outlet passage being made by rotation of the ice making tray by an angle smaller than an ice separating angle at which the ice making tray is rotated to separate ice from the ice making tray;

a sensor configured to detect a temperature of water in the ice making tray or a surface of the ice making tray; and a microprocessor configured to receive the detected temperature, determine whether a surface portion of the water in the ice making tray is frozen based on the detected temperature, and, based on the determination, provide, to the driving unit, a control signal that rotates the ice making tray by the angle smaller than the ice separating angle so as to make the cool air outlet or rotates the ice making tray by the ice separating angle so as to separate ice from the ice making tray.

10. The refrigerator of claim 9, further comprising at least one heater that is associated with the ice maker and configured to heat the ice making tray to promote separation of ice from the ice making tray.

11. The refrigerator of claim 10, further comprising:

a control unit configured to determine whether an ice making operation is completed based on a predetermined time elapsing or detecting a temperature of the ice making tray and configured to provide a control signal to the at least one heater to heat the ice making tray based on a determination that the ice making operation is completed.

12. An ice making method in a refrigerator, comprising:

supplying, through a cool air inlet, cool air to an ice making tray retaining water;

determining whether a surface portion of water retained in the ice making tray is frozen;

based on determining that the portion of water is frozen, establishing a cool air outlet passage by rotating the ice making tray by an angle smaller than an ice separating angle at which the ice making tray is rotated to separate ice from the ice making tray; and separating ice from the ice making tray by rotating the ice making tray by the ice separating angle when the water retained in the ice making tray is entirely frozen.

13. The method of claim 12, wherein determining whether the portion of water retained in the ice making tray is frozen comprises detecting a temperature of the ice making tray.

14. The method of claim 12, further comprising, before separating the ice from the ice making tray, heating the ice making tray by at least one heater.

15. The method of claim 12, further comprising:

stopping supply of cool air into the ice making tray prior to separating the ice.

16. The refrigerator of claim 1, further comprising a control unit that is configured to:

control supply of water into the ice making tray when the ice making tray is oriented at a horizontal angle at which a surface of the ice making tray is perpendicular to a direction of gravity;

detect that a surface portion of water retained in the ice making tray is frozen;

based on detection of the surface portion of water retained in the ice making tray being frozen, control the ice making tray to rotate from the horizontal angle to the angle that is smaller than the ice separating angle and maintain that the ice making tray at the angle that is smaller than the ice separating angle to continue freezing of water retained in the ice making tray;

determine that the water retained in the ice making tray is entirely frozen when the ice making tray is oriented at the angle that is smaller than the ice separating angle; and based on the determination that the water retained in the ice making tray is entirely frozen, control the ice making tray to rotate from the angle that is smaller than the ice separating angle to the ice separating angle to separate ice from the ice making tray.

17. A refrigerator, comprising:

an ice maker positioned in the refrigerator and configured to make ice;

an ice making tray associated with the ice maker and configured to retain water to be frozen;

a plate positioned at an open side of the ice making tray and configured to reduce water overflow from the ice making tray;

a cool air inlet passage configured to allow cool air to be introduced to an area inside of the plate; and a cool air outlet passage that is separate from the cool air inlet passage, and configured to allow release, to an exterior of the plate, of the cool air introduced to the area inside of the plate, wherein the cool air outlet passage is formed to be perpendicular or inclined upwardly toward the outside of the plate.

18. The refrigerator of claim 17, wherein the cool air outlet passage is formed to be perpendicular toward the outside of the plate.

19. The refrigerator of claim 17, wherein the cool air outlet passage is formed to be inclined upwardly toward the outside of the plate.

20. The refrigerator of claim 17, wherein the cool air inlet passage comprises a first slot defined through the plate and the cool air outlet passage comprises a second slot defined through the plate, the second slot being different than the first slot.

* * * * *